US005725235A

United States Patent [19]

Boehm et al.

[11] Patent Number: 5,725,235

[45] Date of Patent: Mar. 10, 1998

[54] DEVICE FOR IMPROVED EDGE CONTROL DISTRIBUTION FOR A SKI BINDING

[75] Inventors: Alfred Boehm, Polling; Werner Messerschmidt, Garmisch-Partenkirchen, both of Germany

[73] Assignee: Marker Deutshcland GmbH, Germany

[21] Appl. No.: 390,058

[22] Filed: Feb. 17, 1995

[51] Int. Cl.[6] ..... A63C 7/10

[52] U.S. Cl. ..... 280/605; 280/607; 280/636

[58] Field of Search ..... 280/607, 617, 280/636, 605, 602, 618, 633

[56] References Cited

U.S. PATENT DOCUMENTS

| | | | |
|---|---|---|---|
| 2,705,150 | 3/1955 | Hansen | 280/636 X |
| 4,135,728 | 1/1979 | Salomon | 280/605 |
| 4,216,976 | 8/1980 | Krob | 280/605 |
| 4,272,099 | 6/1981 | Svoboda et al. | 280/636 X |
| 4,288,093 | 9/1981 | Krob et al. | 280/636 X |
| 4,355,817 | 10/1982 | Krob et al. | 280/636 X |
| 5,056,808 | 10/1991 | Klaus et al. | 280/617 |
| 5,085,453 | 2/1992 | Bildner . | |
| 5,211,417 | 5/1993 | Klaus et al. | 280/617 |

FOREIGN PATENT DOCUMENTS

| | | | |
|---|---|---|---|
| 393 798 B | of 0000 | Austria . | |
| 2 553 671 | 10/1983 | France | A63C 9/081 |
| 2639 242 | 11/1988 | France | A63C 9/00 |
| 41 00 327 A1 | of 0000 | Germany . | |
| PCT/FR92/01082 | of 0000 | WIPO . | |
| WO93/15797 | 8/1993 | WIPO . | |

*Primary Examiner*—Brian L. Johnson
*Assistant Examiner*—Michael Mar
*Attorney, Agent, or Firm*—D. Peter Hochberg; Mark Kusner

[57] ABSTRACT

A ski boot is supported vertically on a ski by means of a rigid support member, approximately in alignment with the longitudinal axis of the tibia of the skier's leg. The support member increases the ground pressure of the center region of the ski.

1 Claim, 2 Drawing Sheets

DEVICE FOR IMPROVED EDGE CONTROL DISTRIBUTION FOR A SKI BINDING

FIELD OF THE INVENTION

The present invention generally relates to a device that supports a ski boot on a ski and channels the weight of the skier at least partially into the center of the ski (i.e., the optimum pivot point of the ski).

BACKGROUND OF THE INVENTION

Patent No. WO 93/15 797 discloses a spring arranged on the upper side of the ski in the central region of the ski. The spring forces the pedal of a ski brake against the underside of a ski boot sole. Thus, when the ski boot is fixed in the ski binding ready for commencing to ski, the pedal of the ski brake is stressed against the underside of the boot sole between the heel and ball-of-the-foot region by the above-mentioned spring. In this respect, the above-mentioned spring tries to lift the ski boot from the ski. Accordingly, some of the weight of the skier is transmitted onto the central region of the ski, corresponding to the stressing force of said spring. However, during skiing phases in which the skier relieves pressure from the ski, (e.g., on the initiation of turning movements) the stressing force of the spring results in a pronounced tightening or stressing occurring between the ski boot and the ski binding parts, which secure the boot against lifting from the ski. The release behavior of the ski binding parts can thereby be impaired. In order to avoid this impairment, the stressing force of the spring must be correspondingly low. Accordingly, only a low proportion of the weight of the skier is transmitted onto the ski in the region of the ski brake pedal.

The present invention overcomes these and other drawbacks of the prior art.

SUMMARY OF THE INVENTION

In one ski binding arrangement, it has been determined that a skier gets better edge control if the boot is held further above the ski than under prior arrangements. This is accomplished by having a spacer plate attached adjacent the ski, and a base plate which can be integral with the heel piece mounted on the spacer plate. The brake pedal is mounted forwardly of the heel piece. The spring of the brake pedal urges the brake pedal upwardly (to urge the ski brakes downwardly), and this puts upward pressure on the sole of a ski boot in the binding. The force of the ski boot is exerted on the pedal rather than entirely on the heel piece, and the present invention has means for directing the force from the ski boot to a preferred place on the ski to obtain better edge control.

The present invention takes into consideration human anatomy with regard to transmission of the skier's weight onto a ski, and with regard to discharging forces acting in the direction of the longitudinal axis of the tibia (or shinbone) of the skier's leg, directly onto the upper side of the ski. The rigidity or inelasticity of the support member of the present invention ensures that the weight forces acting in a downward direction on the ski will have a strong effect on the ski. Accordingly, a maximum ground-pressure of the ski can be achieved in the region of the ski aligned with the longitudinal axis of the skier's tibia. Tests have shown that the foregoing arrangement provides significantly improved skiing comfort and control of the ski.

The rigidity or inelasticity of the support member prevents the occurrence of considerable tightening or stressing between the ski binding parts and the ski boot when the skier relieves pressure from the ski. In this respect, the compressive forces acting between the support member and the ski boot sole assume only imperceptible values, even when the ski boot sole is at a slight distance from the upper side of the ski. These compressive forces are thus completely negligible in the vertical direction, long before the elasticity range of the ski binding parts is used up.

In accordance with a preferred embodiment of the present invention there is provided a ski brake pedal which is arranged in alignment with the longitudinal axis of the skier's tibia, and provides support between the ski boot sole and the upper side of the ski or a support member which is fixed to the ski, such as a spacer plate.

According to the present invention there is provided a support member comprised of a supporting element, the supporting element supporting a ski boot vertically on a ski, approximately in alignment with the longitudinal axis of the skier's tibia. The supporting element bears on the upper surface of the ski, and a ski brake pedal is arranged between the supporting element and the ski boot. The supporting element is rigid or inelastic.

In accordance with a preferred embodiment of the present invention, there is provided a ski binding toe piece or part and a ski binding heel piece or part, each said ski binding part arranged on a ski with the interposition of a respective front and rear spacer plate. The front spacer plate includes a continuation portion which bears on the upper side of the ski, is directed towards the rear spacer plate, and can be displaced relative to the ski in the longitudinal direction of the ski. The upper side of the continuation portion forms, at least beneath the longitudinal axis of the skier's tibia, a ramp which decreases in height in the rearwards direction of the ski. A ski brake pedal bears on the upper surface of the ramp. Alternatively, a supporting element is interposed between the ski brake pedal and the ramp.

In accordance with a preferred embodiment of the present invention the continuation portion continues into a cutout arranged in the rear spacer plate. The cutout extends in the longitudinal direction of the ski and telescopically receives the continuation portion to counteract a dampening resistance produced, for example, by friction-counteracting telescopic movements.

In accordance with another preferred embodiment, in situations where the heel piece of the ski binding moves longitudinally with the ski as the ski bends and the brake pedal moves longitudinally with the heel piece, the support member interposed between the brake pedal and the ski (or a member attached to the ski) also moves longitudinally with the pedal. Therefore, forces transmitted by the ski boot to the pedal are transferred to the support member and to the ski—even though the pedal may have moved longitudinally on the ski—since the support member would have moved with the pedal.

It is an object of the present invention to provide an arrangement that transmits high proportions of the skier's weight directly onto the central region of the ski.

It is another object of the present invention to provide an arrangement which improves edge control of the ski.

It is still another object of the present invention to provide an arrangement which allows the ski to be turned more easily.

These and other objects will become apparent from the following description of preferred embodiments taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof and wherein.

DETAILED DESCRIPTION OF THE PREFERRED EMBODIMENT

Figure 1A:
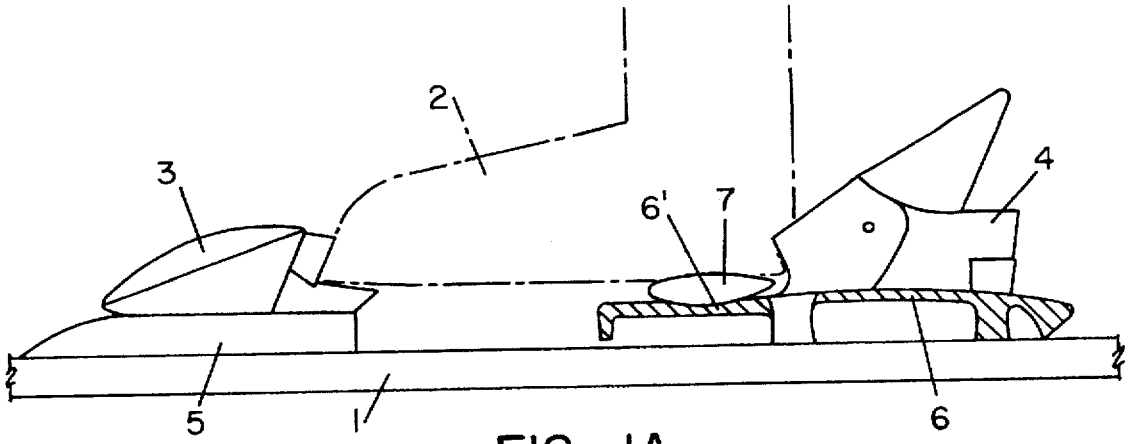
FIG. 1A is a cross-sectional side view of a ski with a preferred embodiment of the present invention.

Referring now to the drawings wherein the showings are for the purpose of illustrating preferred embodiments of the invention only, and not for the purpose of limiting same, FIG. 1A shows a first preferred embodiment of the present invention. A ski binding toe piece or front ski binding part 3 and a ski binding heel piece or rear ski binding part 4 are arranged on a ski 1 to fix a ski boot 2 to ski 1. Spacer plates 5 and 6 are respectively interposed between ski binding parts 3 and 4 and ski 1. It will be appreciated that spacer plates 5 and 6 may also be integral constituent parts of ski binding parts 3 and 4, respectively. A ski brake pedal 7 is preferably mounted to rear ski binding part 4, and is otherwise not shown in any greater detail.

Vertical forces are transmitted by ski boot 2 onto ski 1 in the downward direction. In the region of front ski binding part 3, the vertical forces are transmitted via the portion of spacer plate 5 located beneath the toe region of ski boot 2. At the heel region of ski boot 2, vertical forces acting in the downwards direction are transmitted onto ski brake pedal 7. Ski brake pedal 7 transmits the downward vertical forces onto a support member in the form of portion 6' of rear spacer plate 6. Alternatively, portion 6' of rear spacer plate 6 may be removed, thus allowing ski brake pedal 7 to transmit downward vertical forces directly onto ski 1.

Figure 1B:
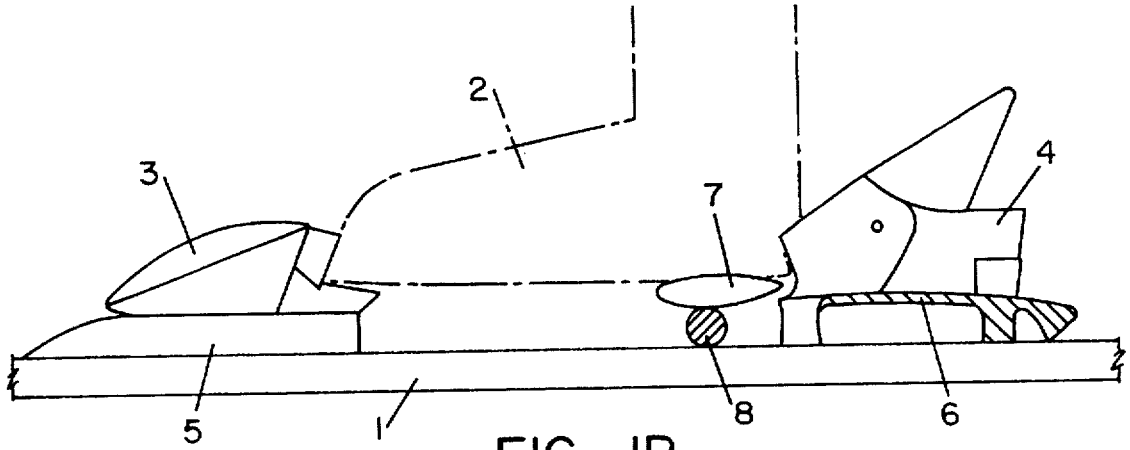
FIG. 1B is a cross-sectional side view of a ski with another preferred embodiment of the present invention.

In the embodiment of the present invention shown in FIG. 1B, the supporting member takes the form of a supporting element 8 that is arranged between the ski brake pedal and the upper surface of ski 1. In accordance with this embodiment ski brake pedal 7 transmits downward vertical forces onto supporting element 8. It should be noted that in this embodiment portion 6' of spacer plate 6 is removed.

It will be appreciated that supporting element 8 may have an adjustable height. In this respect, supporting element 8 may be elliptical in shape, and thus have a height which is adjustable by rotation of the supporting element.

The above-mentioned compressive forces may either act predominantly on supporting element 8 or a more or less large proportion of said forces may be transmitted onto portion 6' of spacer plate 6. In addition, the compressive forces may be transmitted onto the region of spacer plate 6 beneath rear binding part 4 via a raised step portion or the like which is formed on spacer plate 6 at a position beneath ski brake pedal 7.

Figure 1C:
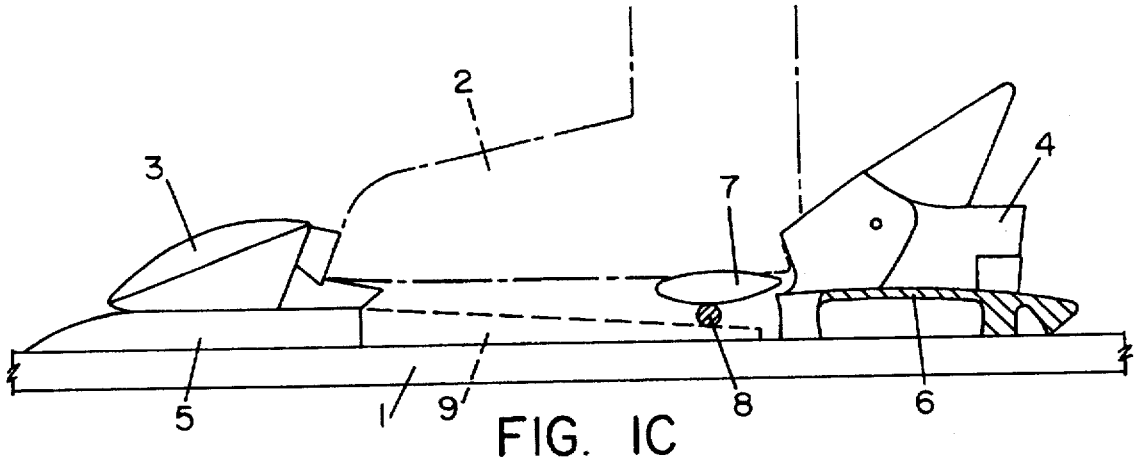
FIG. 1C is a cross-sectional side view of a ski with still another preferred embodiments of the present invention.

Referring now to FIG. 1C, there is shown another preferred embodiment of the present invention wherein supporting element 8 rests on a continuation portion 9. Accordingly, supporting element 8 and continuation portion 9 form a support member. Continuation portion 9 bears on the upper side of ski 1 such that it can be displaced in the longitudinal direction of ski 1. The front end of continuation portion 9 is fixedly connected to front spacer plate 5, which is arranged such that it is fixed to ski 1. Alternatively, continuation portion 9 is configured in one piece with spacer plate 5. The upper side of continuation portion 9, beneath supporting element 8, forms a ramp which decreases in height in the longitudinal rearwards direction of ski 1. Therefore, when continuation portion 9 is displaced in the longitudinal direction of ski 1, it lifts supporting element 8 in the upwards direction or releases supporting element 8 in the downwards direction. Longitudinal displacement of continuation portion 9 takes place when ski 1 bends, with upwards or downwards bending of the ends of the ski. In the event of upwards bending of the ski ends, continuation portion 9 is displaced rearwards in the longitudinal direction of the ski, in particular in the region of the ramp beneath supporting element 8. In the event of downwards bending of the ski ends, continuation portion 9 is displaced in the forward direction.

Alternatively, the support member may be comprised solely of continuation portion 9. In this case, ski brake pedal 7 rests directly on continuation portion 9 without supporting element 8 interposed therebetween.

In the event of upwards bending of the ski ends, the central region of ski 1 between ski binding parts 3 and 4, will try to move further from the sole of ski boot 2, as a result of the arcuate bending occurring in this region of ski 1. Accordingly, the increase in the spacing between the upper side of ski 1 and the sole of ski boot 2 is compensated for by the ramp of continuation portion 9 being displaced in the longitudinal rearwards direction of the ski (i.e., continuation portion 9 fills the gap between the upper side of ski 1 and the sole of ski boot 2). Therefore, a considerable proportion of the skier's weight can be transmitted onto a region of ski 1 in alignment with the longitudinal axis of the skier's tibia. Transmission of the skier's weight onto the region of ski 1 in alignment with the longitudinal axis of the skier's tibia increases the ground-pressure of ski 1 to large values in said region of ski 1.

In the event of downwards bending of the ski ends, the central region of ski 1 between binding parts 3 and 4, will try to draw closer to the sole of ski boot 2. Accordingly, the reduction in spacing between the upper side of ski 1 and the sole of ski boot 2 is compensated for by the ramp of continuation portion 9 being displaced in the longitudinal forward direction of the ski. Therefore, the bending movement of ski 1 is possible in a manner free of constraint.

As noted above, the foregoing embodiment of the present invention provides a continuation portion 9 which is secured such that it is fixed to ski 1 only at front spacer plate 5 (i.e., in the vicinity of the toe end of the ski boot), and is displaced relative to ski 1 in the longitudinal direction of ski 1 when ski 1 bends, with upwards or downwards bending of the ends of the ski. This displacement is based on the fact that the "neutral axis" of ski 1, which is at a certain spacing from the upper side of ski 1, does not undergo any change in length when the ski bends (i.e., the "neutral axis" is neither in compression nor tension as the ski bends). The magnitude of the above-mentioned displacement increases as the distance from the toe of the ski boot increases.

Since supporting element 8 or ski brake pedal 7 is supported on the ramp-shaped upper side of continuation portion 9, continuation portion 9 can compensate for the change of spacing taking place or trying to take place between the ski boot sole and the upper side of ski 1 when ski 1 bends. In the case of upwards bending of the ski ends, when the skier subjects ski 1 to high loading overall, considerable forces can be transmitted onto the upper side of the ski in the region aligned with the longitudinal axis of the skier's tibia. Accordingly, the ground-pressure of the ski is considerably increased in the region of the ski aligned with the longitudinal axis of the skier's tibia, in such skiing situations.

It will be appreciated that continuation portion 9 may project into a corresponding cutout in rear spacer plate 6, which extends in the longitudinal direction of ski 1. Continuation portion 9 is displaced relative to rear spacer plate 6 upon bending of ski 1. Displacement of continuation portion 9 takes place against a damping resistance, which is generated, for example, by friction between a friction surface of continuation portion 9 and a mating friction surface on rear spacer plate 6. Accordingly, bending movements of ski 1 may also be damped.

It should be appreciated that continuation portion 9 may alternatively be fixedly connected to rear spacer plate 6 and project into a corresponding cutout in front spacer plate 5.

In order to allow bending movements of ski 1 in a manner free of constraint, the longitudinal spacing between front ski binding part 3 and rear ski binding part 4 must be variable. Accordingly, rear ski binding part 4 is secured such that it can move in the longitudinal direction of ski 1 and be forced in the forwards direction against ski boot 2 by means of a so-called advancement spring arrangement. Since the ski brake for each of the above-described preferred embodiments of the present invention is mounted on rear ski binding part 4, the ski brake is also affected by the above-mentioned advancement movements of ski binding heel part 4. Accordingly, ski brake pedal 7 is movable with heel part 4 in the longitudinal direction, and thus does not move (i.e., remains at rest) relative to ski boot 2.

It will also be appreciated that a base plate may be arranged beneath ski binding heel part 4. The base plate may extend under pedal 7. Accordingly, any forces acting on pedal 7 will be transmitted through the base plate. The spacer plate raises the boot holding surface further above the ski, to increase the movement between the ski boot and the ski, and to thereby increase the force on the edges of the ski during turning. When the heel piece and its related members are constructed to move longitudinally on the ski as the ski bends, brake pedal 7 moves longitudinally as well. In order to continue directing forces from the skier's leg to the preferred part of the ski, the supporting member 8 moves with the pedal to direct its force according to the invention, even where the heel piece moves longitudinally as during bending.

Figure 2:
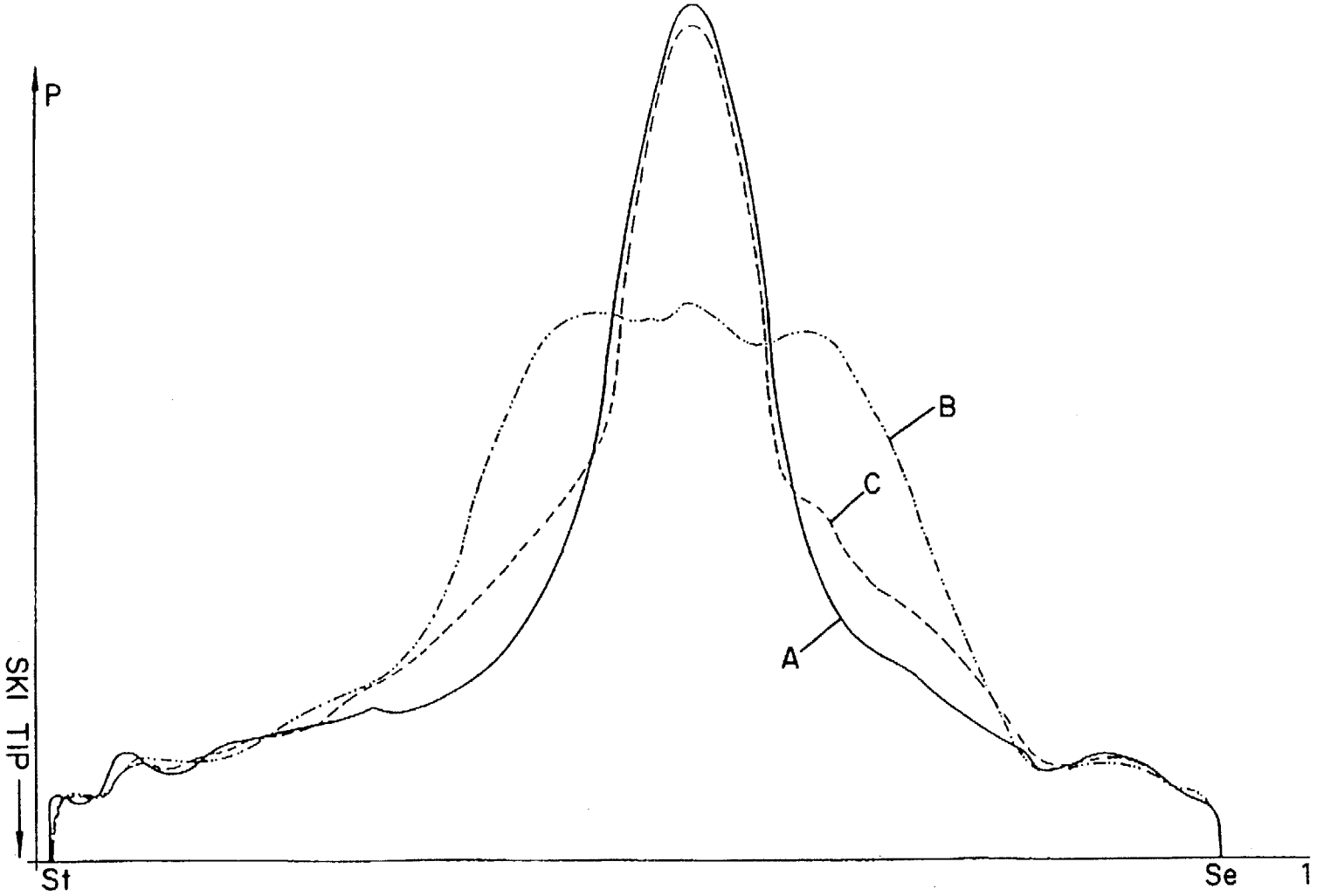
FIG. 2 is a graph showing the ground-pressure distribution of the ski in the longitudinal direction of the ski, at various settings.

Referring now to FIG. 2 there is shown a ground-pressure distribution of ski 1 in the longitudinal direction. The graph illustrates the ground-pressure (denoted as "P") distribution achievable between the front end or tip of the ski (denoted as "St") and the rear end of the ski (denoted as "Se").

In particular, curve A illustrates the ground-pressure distribution (or normal force dispersion) obtained when ski 1 alone is laid, by its underside, on a planar surface and is pressed onto the planar surface by means of a ram or the like, acting in the center of the ski. It should be understood that the term "ground-pressure" refers to the force applied by the ski to the ground. Curve A shows a progressively increasing ground-pressure from the ends of the ski to the center of the ski and a distinct ground-pressure maximum in the center region of the ski.

Curve C illustrates the ground-pressure distribution obtained when the support members and binding arrangements shown in FIGS. 1A, 1B and 1C are mounted on ski 1 and vertical downwards forces are exerted onto ski 1 (lying on a planar surface) via ski boot 2. Accordingly, the ground-pressure distribution corresponding to curve C may be obtained when ski brake pedal 7 is operatively supported on ski 1 via supporting element 8 in a region in alignment with the longitudinal axis of the skier's tibia. Curve C is, to a large extent, similar to curve A; however, curve C has a smaller slope (i.e., a flatter curve) on either side of the central ground-pressure maximum. The ground-pressure maximum in the center region of the ski forces the center of the ski to contact the ground and increases pressure on the edges of the ski, thus providing better edge control of the ski. Accordingly, a skier can more easily turn the ski.

Curve B illustrates the ground-pressure distribution obtained when there is no effective vertical support of ski boot 2 on the upper side of ski 1 in the region of the ski in alignment with the longitudinal axis of the skier's tibia, and the vertical forces are channelled into ski 1 merely in the region of ski binding parts 3 and 4. Curve B has a wide "camel-hump" region in the central region of ski 1. The "camel hump" indicates that the ground-pressure of ski 1 is comparatively large in the region of binding parts 3 and 4, and is comparatively small in the region between binding parts 3 and 4, as compared with curves A and C in each case. Accordingly, the distribution of forces indicated by curve B will provide a ski that is difficult to turn.

It should be appreciated that adjusting the support member for ski boot 2 in the region aligned with the longitudinal axis of the skier's tibia can also result in ground-pressure distributions which lie between curves C and B illustrated in FIG. 2. For instance, a modified curve B may have an increasingly narrower central region with an increasingly higher central maximum.

The foregoing description is for specific embodiments of the present invention. It should be appreciated that these embodiments are described for purposes of illustration only and that numerous alterations and modifications may be practiced by those skilled in the art without departing from the spirit and scope of the invention. It is intended that all such modifications and alterations be included insofar as they come within the scope of the invention as claimed or equivalents thereof.

The invention claimed is:

1. A device for supporting a ski boot on a ski, and channeling at least some of a skier's weight to the center region of the ski, said device comprising:

a ski binding toe piece and a ski binding heel piece for fixing a ski boot on said ski;

a toe spacer plate and a heel spacer plate fixedly secured between an upper surface of said ski and said toe and heel pieces respectively;

a ski brake assembly including a brake pedal positioned for engagement with a bottom surface of the heel portion of the skier's boot and aligned with the longitudinally axis of the skier's tibia;

a continuation portion having a forward end fixedly attached to said toe spacer plate and extending rearwardly therefrom, said continuation portion having a free rearward end portion which is movable in a longitudinal direction relative to the upper surface of said ski in response to bending movements of said ski and an upper surface which declines in a rearwardly direction to form a downwardly sloping ramp; and, a support member positioned between said brake pedal and said rearward end portion of said ramp and in engagement therewith when said ski boot is secured to said toe and heel pieces, wherein said support member is movable relative to said ramp in a longitudinal direction along said ramp in response to bending movements of said ski.

* * * * *